US011242973B2

(12) United States Patent
Roels et al.

(10) Patent No.: US 11,242,973 B2
(45) Date of Patent: Feb. 8, 2022

(54) LIGHTING DEVICE FOR A MOTOR VEHICLE HAVING AT LEAST ONE PIXELATED LIGHT SOURCE

(71) Applicant: VALEO VISION, Bobigny (FR)

(72) Inventors: Sebastien Roels, Bobigny (FR); Marie Pellarin, Bobigny (FR); Sophie Clade, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 17/045,114

(22) PCT Filed: Apr. 3, 2019

(86) PCT No.: PCT/EP2019/058429
§ 371 (c)(1),
(2) Date: Oct. 2, 2020

(87) PCT Pub. No.: WO2019/193066
PCT Pub. Date: Oct. 10, 2019

(65) Prior Publication Data

US 2021/0148536 A1 May 20, 2021

(30) Foreign Application Priority Data

Apr. 3, 2018 (FR) ..... 1852897

(51) Int. Cl.
*F21S 41/663* (2018.01)
*F21S 41/25* (2018.01)
(Continued)

(52) U.S. Cl.
CPC ..... *F21S 41/663* (2018.01); *F21S 41/143* (2018.01); *F21S 41/25* (2018.01); *F21S 45/47* (2018.01); *F21W 2102/13* (2018.01)

(58) Field of Classification Search
None
See application file for complete search history.

(56) References Cited

U.S. PATENT DOCUMENTS

2008/0239746 A1 10/2008 Wuller et al.
2008/0316759 A1 12/2008 Valcamp et al.
(Continued)

FOREIGN PATENT DOCUMENTS

DE 102005041234 A1 3/2007
DE 102007052745 A1 5/2009
(Continued)

OTHER PUBLICATIONS

European Patent Office, International Search Report and Written Opinion of Application No. PCT/EP/2019/058429, dated Sep. 24, 2019.

*Primary Examiner* — Elmito Breval
(74) *Attorney, Agent, or Firm* — Valeo Vision

(57) ABSTRACT

The invention relates to a motor vehicle lighting device that includes a first module with at least one first pixelated electroluminescent light source where the first module can produce a first pixelated partial high beam (HB1) having a first resolution and a first horizontal angular amplitude; and includes a second module with a second pixelated electroluminescent light source where the second module can produce a second pixelated partial high beam (HB2) having an angular amplitude smaller than that of the first pixelated partial high beam (HB1) and a resolution greater than that of the first pixelated partial high beam (HB2); the pixelated electroluminescent light sources preferably being monolithic.

13 Claims, 2 Drawing Sheets

(51) Int. Cl.

| | |
|---|---|
| ***F21S 41/143*** | (2018.01) |
| ***F21S 45/47*** | (2018.01) |
| *F21W 102/13* | (2018.01) |

(56) References Cited

U.S. PATENT DOCUMENTS

| | | | | |
|---|---|---|---|---|
| 2010/0264824 | A1 | 10/2010 | Gotz et al. | |
| 2011/0235349 | A1 | 9/2011 | Nakaya et al. | |
| 2015/0377442 | A1* | 12/2015 | Bhakta ..... | F21S 41/25 362/510 |

FOREIGN PATENT DOCUMENTS

| | | | |
|---|---|---|---|
| DE | 102015225105 | A1 | 6/2017 |
| DE | 102016211653 | A1 | 12/2017 |
| EP | 2772682 | A2 | 9/2014 |
| JP | 2013168434 | A | 8/2013 |
| WO | 2006034329 | A2 | 3/2006 |

* cited by examiner

LIGHTING DEVICE FOR A MOTOR VEHICLE HAVING AT LEAST ONE PIXELATED LIGHT SOURCE

CROSS-REFERENCE TO RELATED APPLICATIONS

This application is filed under 35 U.S.C. § 371 U.S. National Phase of International Application No. PCT/EP2019/058429 filed Apr. 3, 2019 (published as WO2019193066), which claims foreign priority benefit to French application No. 1852897 filed on Apr. 3, 2018, the disclosures of which are incorporated herein by reference in their entirety.

TECHNICAL FIELD

Recent developments in the field of these motor vehicle lighting devices have made it possible to bestow additional functions on them.

It is thus possible to produce a pixelated light beam with which the lighting device is able to perform localized lighting functions, for example project a pattern onto the scene. Such functions are known from the field of adaptive lighting or ADB, acronym for "adaptive driving beam". Lighting in the form of a glare-free high beam is known, for example, consisting for example in darkening an area corresponding to an oncoming vehicle so as not to dazzle this other user while at the same time illuminating around the vehicle being passed or followed. Also known is the bend lighting function or DBL (acronym for "dynamic bending light"), which modifies the illuminated area of the scene when the vehicle has a direction that is not straight, for example on a bend or at a road intersection.

Various technologies such as a DMD or an LCD screen have been proposed to produce this pixelated beam. However, their cost is still at present very high, prohibiting mass distribution. In addition, as disclosed in patent document EP 2 772 682, their efficiency in terms of lighting remains limited, thereby requiring an increase in the number of modules equipped with these technologies in order to offer a wide pixelated lighting field.

In order to reduce the price of the lighting device, it has thus been proposed, for example in patent document EP 2 772 682, to limit the pixelated beam to a restricted extent, by combining it with complementary non-pixelated beams that lead to a satisfactory extent of the high beam.

BACKGROUND

Light sources generate a big amount of heat which needs to be dissipated, so that the operation of said light sources is not jeopardized. This issue is even more important when light sources are light emitting diodes (LEDs), since temperature has a big impact on the operational properties of said light sources.

Heatsinks are known to solve this problem. A heatsink is located in thermal contact with the light source, and this heatsink is provided with fins or any other suitable element, which dissipate the heat coming from the heatsink by convection or radiation, so that air surrounding the heater is heated and then wasted.

Heatsinks are usually glued to the PCB where the LEDs are installed, using a glue which is thermally conductive. With this arrangement, heat is transferred from the PCB to the heatsink and then dissipated by the fins.

Another option is arranging the heater outside the luminous device, but heat transfer is more difficult. Heat pipes are usually used, such as in document US 2008/247177 A1. A lighting element connected to a heat pipe is less versatile, since heat pipes do not usually allow a free movement of the associated element.

SUMMARY

The aim of the invention is therefore to propose a motor vehicle lighting device that produces a pixelated high beam having a large horizontal extent and a high resolution, while at the same time having a satisfactory maximum intensity, all while being more economical than known solutions.

In this respect, the first subject of the invention is a motor vehicle lighting device comprising:

a first module comprising at least one first pixelated electroluminescent light source, the first module being able to produce a first pixelated partial high beam having a first resolution and a first horizontal angular amplitude;

a second module comprising a second pixelated electroluminescent light source, the second module being able to produce a second pixelated partial high beam having an angular amplitude smaller than that of the first pixelated partial high beam and a resolution greater than that of the first pixelated partial high beam.

It will be understood that, with this configuration having two modules with pixelated electroluminescent light sources and having different resolutions, a pixelated high beam is advantageously obtained over a satisfactory extent while at the same time keeping a high resolution in a part of the beam, in particular a central part, that which is at the intersection of the horizontal and vertical axes, that corresponds to the maximum intensity of a high beam as defined by the regulations, in particular R112 ECE, all versions since 1995.

In addition, this solution is particularly economical in comparison with DMD or LCD components.

The resolution of the first and second pixelated beams may be estimated by the number and the dimensions of the pixels forming these beams with respect to the amplitudes of these beams.

Preferably, the first lighting module and the second lighting module are arranged such that, respectively, the first pixelated partial high beam and the second pixelated partial high beam each have at least 400 pixels.

According to one embodiment, the first lighting module may be arranged such that the first pixelated partial high beam has at least 400 pixels, or even at least 1000 pixels, or even at least 2000 pixels. This first pixelated beam may for example comprise 20 columns and 20 rows of pixels, in particular 32 columns and 32 rows of pixels. Advantageously, the first pixelated partial high beam has more columns than rows and therefore extends more in terms of width than in terms of height when it is projected onto a measuring screen 25 m from the lighting device.

Advantageously, the first module may be arranged such that each pixel of the first pixelated beam has a width and/or a height less than or equal to 1°, in particular less than or equal to 0.5°.

Also advantageously, the first lighting module may be arranged such that the first lighting module is arranged such that the first pixelated partial high beam has a vertical amplitude at least equal to 4°, preferably up to 9° and a horizontal amplitude at least equal to 25°, preferably up to 50°.

Advantageously, the second module is arranged such that each pixel of the second pixelated partial high beam has a width and/or a height less than or equal to 0.5°, preferably less than or equal to 0.3°.

Also advantageously, the second lighting module is arranged such that the second pixelated partial high beam has a vertical amplitude at least equal to 2° and at most equal to 6° and a horizontal amplitude at least equal to 8° and at most equal to 20°, preferably 12°.

The first module and the second module may for example each comprise:

a pixelated light source comprising a plurality of elementary emitters arranged in a matrix array, each of the elementary emitters being able to be activated selectively so as to emit an elementary light beam; and an optical projection system associated with said pixelated light source for projecting each of said elementary light beams in the form of a pixel, the set of pixels forming said pixelated beam.

Advantageously, the optical projection system is arranged such that the pixelated beam has a vertical amplitude of at least 2° and a horizontal amplitude of at least 8°. These horizontal and vertical amplitudes make it possible to ensure that the pixelated beam is projected onto an area of the road that is large enough to perform writing functions on the road by projecting a pattern in this pixelated beam, and in particular ground marking display functions, driving assistance functions and GPS information projection functions, or even adaptive lighting functions that require pixelation of the lighting beam and in particular glare-free high beam functions or dynamic bending lighting functions. The optical projection system may thus comprise one or a combination of several of the following optical components: lens, reflector, guide, collimator, prism.

Where appropriate, the pixelated light source may comprise at least 20 columns and at least 20 rows of elementary emitters, in particular at least 32 rows and columns of elementary emitters. These minimum numbers of columns and rows of elementary emitters, in combination with the abovementioned vertical and horizontal amplitudes, make it possible to obtain, for each of the elementary light beams, once they have been projected by the optical projection system, an angular aperture or of less than or equal to 1°, or even less than or equal to 0.3°. A high resolution of the pixelated beam is thus obtained when it is projected onto the road such that satisfactory perception of said pattern projected in the pixelated beam is guaranteed to a road user and/or to the driver of the vehicle equipped in this way.

Advantageously, the elementary emitters and the optical projection system are arranged such that two neighboring pixels, that is to say two adjacent pixels on one and the same row or on one and the same column, are contiguous, that is to say that their adjacent edges are coincident.

According to a first embodiment of the invention, the lighting device is arranged such that the first pixelated partial high beam and the second pixelated partial high beam at least partially overlap.

According to one alternative embodiment, the lighting device is arranged such that the first pixelated partial high beam and the second pixelated partial high beam are juxtaposed.

In one embodiment of the invention, the pixelated electroluminescent light source is a matrix array of electroluminescent sources (called "solid-state light source"). The pixelated electroluminescent source comprises a plurality of electroluminescent elements arranged in a matrix array in at least two columns and two rows. Examples of electroluminescent elements include the light-emitting diode or LED, the organic light-emitting diode or OLED, or the polymer light-emitting diode or PLED, or even the micro-LED.

In one preferred embodiment of the invention, the pixelated electroluminescent light source of the first module and/or of the second module comprises at least one matrix array of electroluminescent elements (called monolithic array) arranged in at least two columns by at least two rows. Preferably, the electroluminescent source comprises at least one matrix array of a monolithic matrix array of electroluminescent elements, also called a monolithic matrix array.

In a monolithic matrix array, the electroluminescent elements are grown from a common substrate and are electrically connected so as to be able to be activated selectively, individually or by subset of electroluminescent elements. Each electroluminescent element or group of electroluminescent elements may thus form one of the elementary emitters of said pixelated light source that is able to emit light when its or their material is supplied with electricity.

Various arrangements of electroluminescent elements may meet this definition of a monolithic matrix array, provided that the electroluminescent elements have one of their main dimensions of elongation substantially perpendicular to a common substrate and that the spacing between the elementary emitters, formed by one or more electroluminescent elements grouped together electrically, is small in comparison with the spacings that are imposed in known arrangements of flat square chips soldered to a printed circuit board.

The substrate may be made predominantly of semiconductor material. The substrate may comprise one or more further materials, for example non-semiconductor materials.

These electroluminescent elements, of submillimeter dimensions, are for example arranged so as to project from the substrate so as to form rods of hexagonal cross section. The electroluminescent rods originate on a first face of a substrate. Each electroluminescent rod, formed in this case using gallium nitride (GaN), extends perpendicularly, or substantially perpendicularly, projecting from the substrate, in this case produced from silicon, with other materials, such as silicon carbide, being able to be used without departing from the context of the invention. By way of example, the electroluminescent rods could be produced from an alloy of aluminum nitride and of gallium nitride (AlGaN), or from an alloy of aluminum, indium and gallium phosphides (AlInGaP). Each electroluminescent rod extends along a longitudinal axis defining its height, the base of each rod being arranged in a plane of the upper face of the substrate.

The electroluminescent rods of one and the same monolithic matrix array advantageously have the same shape and the same dimensions. They are each delimited by an end face and by a circumferential wall that extends along the axis of elongation of the rod. When the electroluminescent rods are doped and subjected to polarization, the resulting light at the output of the semiconductor source is emitted mainly from the circumferential wall, it being understood that light rays may also exit from the end face. The result of this is that each electroluminescent rod acts as a single light-emitting diode and that the light output of this source is improved firstly by the density of the electroluminescent rods that are present and secondly by the size of the lighting surface defined by the circumferential wall and that therefore extends over the entire perimeter and the entire height of the rod. The height of a rod may be between 2 and 10 μm, preferably 8 μm; the largest dimension of the end face of a rod is less than 2 μm, preferably less than or equal to 1 μm.

It is understood that, when forming the electroluminescent rods, the height may be modified from one area of the pixelated light source to another in such a way as to boost the luminance of the corresponding area when the average height of the rods forming it is increased. Thus, a group of electroluminescent rods may have a height, or heights, that are different from another group of electroluminescent rods, these two groups forming the same semiconductor light source comprising electroluminescent rods of submillimeter dimensions. The shape of the electroluminescent rods may also vary from one monolithic matrix array to another, in particular over the cross section of the rods and over the shape of the end face. The rods have a generally cylindrical shape, and they may in particular have a polygonal and more particularly hexagonal cross section. It is understood that it is important, for light to be able to be emitted through the circumferential wall, that the latter has a polygonal or circular shape.

Moreover, the end face may have a shape that is substantially planar and perpendicular to the circumferential wall, such that it extends substantially parallel to the upper face of the substrate, or else it may have a shape that is curved or pointed at its center, so as to increase the directions in which the light exiting from this end face is emitted.

The electroluminescent rods are arranged in a two-dimensional matrix array. This arrangement could be such that the rods are arranged in quincunx. Generally speaking, the rods are arranged at regular intervals on the substrate and the distance separating two immediately adjacent electroluminescent rods, in each of the dimensions of the matrix array, should be at least equal to 2 μm, preferably between 3 μm and 10 μm, such that the light emitted through the circumferential wall of each rod is able to exit from the matrix array of electroluminescent rods. Provision is furthermore made for these separating distances, measured between two axes of elongation of adjacent rods, not to be greater than 100 μm.

According to another embodiment, the monolithic matrix array may comprise electroluminescent elements formed by layers of epitaxial electroluminescent elements, in particular a first layer of n-doped GaN and a second layer of p-doped GaN, on a single substrate, for example made of silicon carbide, and which is sliced (by grinding and/or ablation) to form a plurality of elementary emitters respectively originating from one and the same substrate. The result of such a design is a plurality of electroluminescent blocks all originating from one and the same substrate and electrically connected so as to be able to be activated selectively from one another.

In one exemplary embodiment according to this other embodiment, the substrate of the monolithic matrix array may have a thickness of between 100 μm and 800 μm, in particular equal to 200 μm; each block may have a width and a width, each being between 50 μm and 500 μm, preferably between 100 μm and 200 μm. In one variant, the length and the width are equal. The height of each block is less than 500 μm, preferably less than 300 μm. Finally, the exit surface of each block may be formed via the substrate on the side opposite the epitaxy. The separating distance between two elementary emitters. The distance between each contiguous elementary emitter may be less than 1 μm, in particular less than 500 μm, and is preferably less than 200 μm.

According to another embodiment that is not shown, both with electroluminescent rods extending respectively projecting from one and the same substrate, as described above, and with electroluminescent blocks obtained by slicing electroluminescent layers superimposed on one and the same substrate, the monolithic matrix array may furthermore comprise a layer of a polymer material in which the electroluminescent elements are at least partially embedded. The layer may thus extend over the entire extent of the substrate, or only around a given group of electroluminescent elements. The polymer material, which may in particular be silicone-based, creates a protective layer that makes it possible to protect the electroluminescent elements without impairing the diffusion of the light rays. Furthermore, it is possible to integrate, into this layer of polymer material, wavelength conversion means, for example luminophores, that are able to absorb at least some of the rays emitted by one of the elements and to convert at least some of said absorbed excitation light into an emission light having a wavelength that is different from that of the excitation light. Provision may be made without distinction for the luminophores to be embedded in the mass of the polymer material, or else to be arranged on the surface of the layer of this polymer material.

The pixelated light source may furthermore comprise a coating of reflective material to deflect the light rays to the exit surfaces of the light source.

The electroluminescent elements of submillimeter dimensions define a given exit surface in a plane substantially parallel to the substrate. It will be understood that the shape of this exit surface is defined as a function of the number and the arrangement of the electroluminescent elements that form it. It is thus possible to define a substantially rectangular shape of the emission surface, it being understood that the latter may vary and adopt any shape without departing from the context of the invention.

The monolithic matrix array or matrix arrays capable of emitting light rays may be coupled to a control unit. The control unit may be mounted on one or more of the matrix arrays, the assembly thus forming a lighting sub-module. In this case, the control unit may comprise a central processing unit coupled to a memory on which there is stored a computer program that comprises instructions allowing the processor to perform steps that generate signals for controlling the light source. The control unit may be an integrated circuit, for example an ASIC (acronym for "Application-Specific Integrated Circuit") or an ASSP (acronym for "Application-Specific Standard Product").

According to a first variant embodiment of the invention, the first pixelated electroluminescent light source and the second pixelated electroluminescent light source have elementary emitters that have an emitting surface of the same size, the first module furthermore comprising a first optical projection system and the second module comprising a second optical projection system, the magnification factor of the second optical projection system being less than that of the first optical projection system, such that the resolution of the second pixelated partial high beam is greater than that of the first pixelated partial high beam.

According to a second variant that is an alternative to the previous one, the second pixelated electroluminescent light source has elementary emitters whose emitting surface is of a size smaller than that of those of the first pixelated electroluminescent light source, the first module furthermore comprising a first optical projection system and the second module comprising a second optical projection system, the magnification factor of the second optical projection system being equal to or less than that of the first optical projection system, such that the resolution of the second pixelated partial high beam is greater than that of the first pixelated partial high beam.

According to one advantageous embodiment of the invention, the first pixelated electroluminescent light source and/ or the second pixelated electroluminescent light source have a total emitting light surface that is rectangular. This advantageously avoids having to resort to anamorphic optical projection systems in order to modify the aspect ratio of the emitting surface and to obtain a projected beam whose dimensions are suitable for motor vehicle lighting.

The invention also relates to the motor vehicle comprising at least one lighting device according to one of the preceding embodiments or variants.

BRIEF DESCRIPTION OF THE DRAWINGS

Other features and advantages of the present invention will be better understood with the aid of the description of the examples and of the drawings, in which.

DETAILED DESCRIPTION

Figure 1:
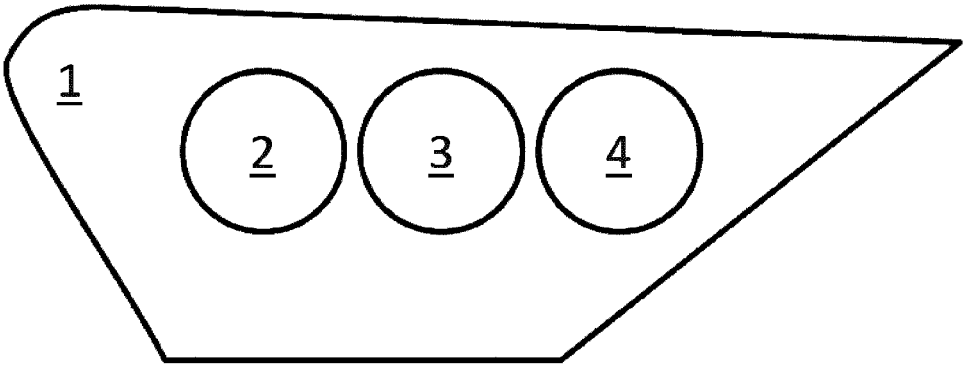
FIG. 1 shows a front view of a lighting device according to one preferred embodiment of the invention.
Figure 2:
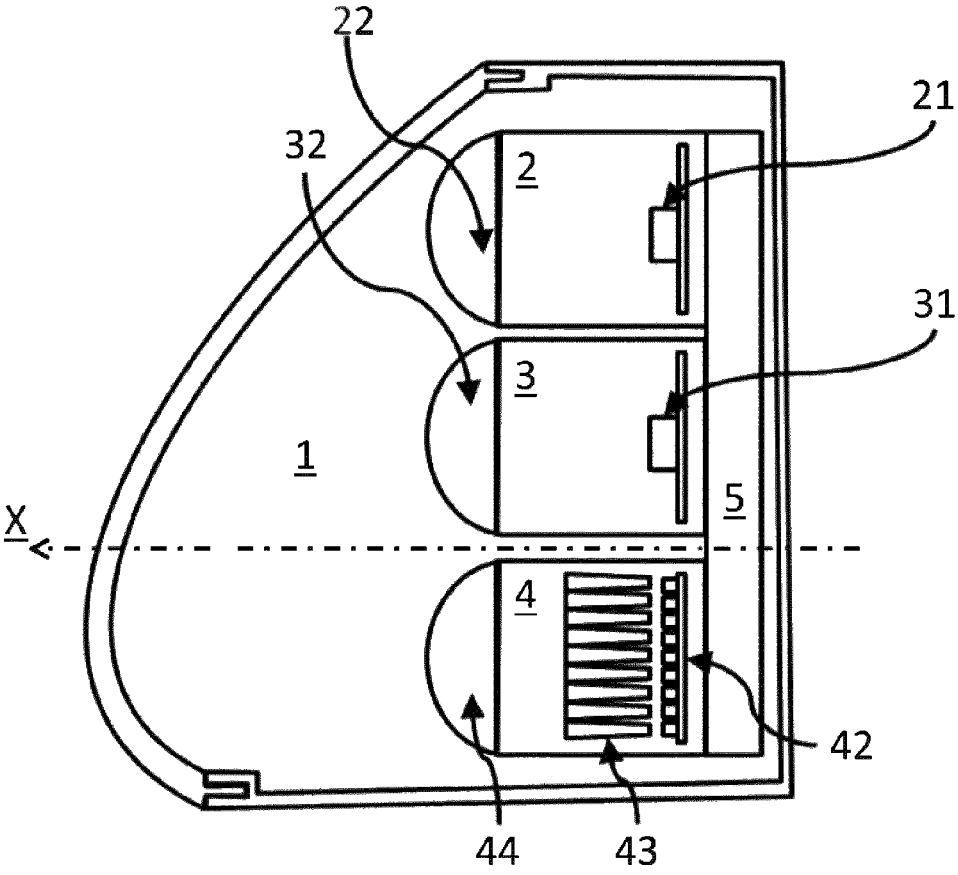
FIG. 2 shows a plan view of FIG. 1.

FIGS. 1 and 2 show a lighting device 1 according to one embodiment of the invention. This lighting device comprises a first lighting module 2 capable of projecting a first pixelated partial high beam HB1 and a second lighting module 3 capable of projecting a second pixelated partial high beam HB2. The first and second pixelated beams HB1 and HB2 have been shown in FIGS. 3 and 4, projected onto a screen placed 25 meters from the lighting device 1 and on which have been formed a horizontal axis H-H representing the horizon and a vertical axis V-V, perpendicular to the horizontal axis H-H and intersecting the optical axis X of the lighting device 1.

The first module 2 comprises:

a pixelated electroluminescent light source 21 comprising for example 900 elementary emitters arranged in a matrix array of 20 rows by 45 columns, each of the elementary emitters being able to be activated selectively so as to emit an elementary light beam; and an optical projection system 22 associated with said light source for projecting each of said elementary light beams in the form of a pixel having a width and a height of 1°.

In the example described, the light source 21 comprises a monolithic matrix array of electroluminescent elements, as described above.

Provision may be made to replace the pixelated electroluminescent light source 21 with any other type of pixelated electroluminescent source described above, such as for example a matrix array of light-emitting diodes.

The set of pixels projected by the first module 2 forms said first pixelated partial high beam HB1. This beam HR has a horizontal amplitude of 25° and a vertical amplitude of 9°. It extends symmetrically on either side of the vertical axis V-V.

The first lighting module comprises at least one pixelated electroluminescent light source 21. It may comprise one, two or three pixelated electroluminescent light sources 21. This makes it possible to obtain a first pixelated partial high beam HB1 of very large horizontal extent.

The first lighting module 2 may comprise elements other than those described above. These elements will not be described in the context of the present invention since they do not interact functionally with the arrangements according to the invention.

The second lighting module 3 is structurally similar to the first lighting module 2.

The second module 3 comprises:

a pixelated electroluminescent light source 31 comprising for example 900 elementary emitters arranged in a matrix array of 20 rows by 45 columns, each of the elementary emitters being able to be activated selectively so as to emit an elementary light beam; and an optical projection system 32 associated with said light source for projecting each of said elementary light beams in the form of a pixel having a width and a height of 0.3°.

The lighting device comprises an additional module 4, intended to produce a complementary low beam LB.

The additional module 4 comprises:

a matrix array 41 of elementary emitters comprising 9 light-emitting diodes able to be activated selectively and arranged along a row, each diode being able to emit an elementary light beam;

a plurality 42 of primary optical elements arranged in front of the matrix array 31 for collecting, formatting and guiding the elementary light beams originating from each of the light-emitting diodes; and projection projection optical system 43 arranged in front of the primary optical elements for projecting each of said elementary light beams originating from the primary optical elements in the form of a pixel having a width of 3° and a length of 5°.

Reference may in particular be made to document FR3056692, which describes the operating principle of such a module.

The second pixelated beam thus forms a pixelated low beam.

Finally, the lighting device 1 comprises a control unit 5 each able to selectively control the light intensity of each of the pixels of the first and second beams HB1 and HB2 on the basis of control instructions that it receives, for example by switching on and by selectively switching off the elementary emitters of the light sources 21 and 31 or else by varying, in an increasing or decreasing manner, the electric power supplied to each of these elementary emitters.

Figure 3:
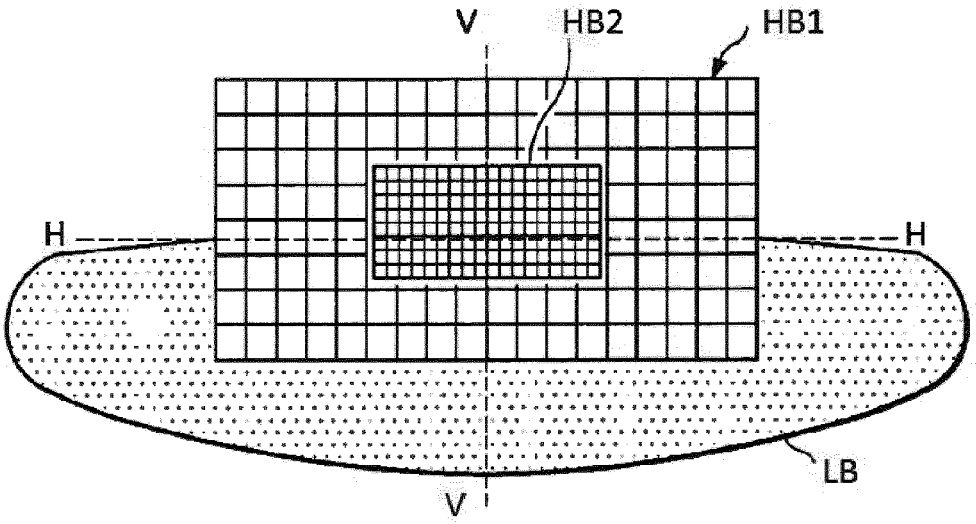
FIG. 3 shows a first configuration of light beams projected by a lighting device according to the invention.

According to a first configuration of the invention, as shown in FIG. 3, the first and second lighting modules 2 and 3 are arranged such that the first and second beams HB1 and HB2 at least partially overlap. In this case, the second beam HB2 is contained in the first beam HB1.

Figure 4:
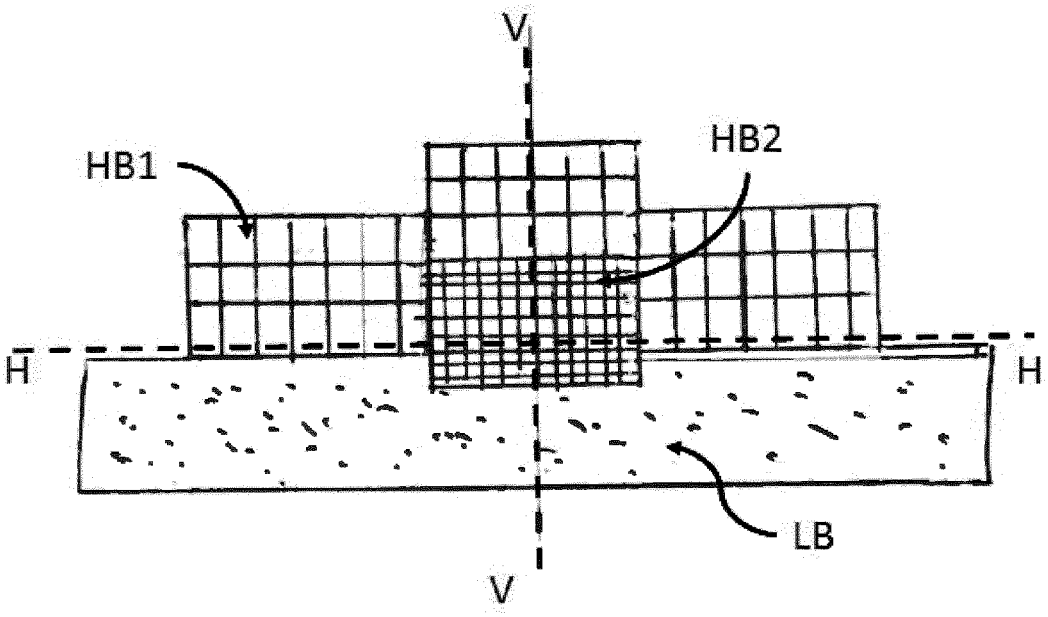
FIG. 4 shows another configuration of light beams projected by a lighting device according to the invention.

According to another configuration of the invention, as shown in FIG. 4, the first and second lighting modules 2 and 3 are arranged such that the first and second beams HB1 and HB2 are adjacent. In this case, the second beam HB2 is framed within the first beam HB1, which is broken down into a plurality of sub-areas. Each of these sub-areas may be generated by a dedicated pixelated electroluminescent light source 21. In the example illustrated, there are three pixelated light sources in order to cover the field and the shape of the pixelated high beam HB1.

What is claimed is:

1. A motor vehicle lighting device comprising:

a first module comprising at least one first pixelated electroluminescent light source, the first module configured to produce a first pixelated partial high beam (HB1) having a first resolution and a first horizontal angular amplitude;

a second module comprising a second pixelated electroluminescent light source, the second module configured to produce a second pixelated partial high beam (HB2) having a second angular amplitude smaller than that of the first pixelated partial high beam (HB1) and a second resolution greater than that of the second pixelated partial high beam (HB2);

further wherein characterized in that the at least one first pixelated electroluminescent light source and the second pixelated electroluminescent light source have elementary emitters that have an emitting surface of the same size, the first module furthermore comprising a first optical projection system and the second module comprising a second optical projection system, the magnification factor of the second optical projection system being less than that of the first optical projection system such that the resolution of the second pixelated partial high beam (HB2) is greater than that of the first pixelated partial high beam (HB1).

2. The lighting device of claim 1, wherein the first lighting module and the second lighting module are arranged such that, respectively, the first pixelated partial high beam (HB1) and the second pixelated partial high beam (HB2) each have at least 400 pixels.

3. The lighting device of claim 1, wherein the first module is arranged such that each pixel of the first pixelated partial high beam (HB1) has a width or a height less than or equal to 1°.

4. The lighting device of claim 1, wherein the first lighting module is arranged such that the first pixelated partial high beam (HB1) has a vertical amplitude at least equal to 4° and a horizontal amplitude at least equal to 25°.

5. The lighting device of claim 1, wherein the second module is arranged such that each pixel of the second pixelated partial high beam (HB2) has a width or a height less than or equal to 0.3°.

6. The lighting device of claim 1, wherein the second lighting module is arranged such that the second pixelated partial high beam (HB2) has a vertical amplitude at least equal to 2° and at most equal to 6° and a horizontal amplitude at least equal to 8° and at most equal to 20°.

7. The lighting device of claim 1, characterized in that said device is arranged such that the first pixelated partial high beam (HB1) and the second pixelated partial high beam (HB2) at least partially overlap.

8. The lighting device of claim 1, characterized in that the lighting device is arranged such that the first pixelated partial high beam (HB1) and the second pixelated partial high beam (HB2) are juxtaposed.

9. The lighting device of claim 1, characterized in that the second pixelated electroluminescent light source has a number of elementary emitters whose respective emitting surfaces are of a size smaller than that of those of the first pixelated electroluminescent light source;

the first module furthermore comprising a first optical projection system and the second module comprising a second optical projection system, the magnification factor of the second optical projection system being equal to or less than that of the first optical projection system such that the resolution of the second pixelated partial high beam (HB2) is greater than that of the first pixelated partial high beam (HB1).

10. The lighting device of claim 1, characterized in that the first pixelated electroluminescent light source or the second pixelated electroluminescent light source has an emitting light surface that is rectangular.

11. A motor vehicle, characterized in that the motor vehicle comprises at least one lighting device of claim 1.

12. The lighting device of claim 1, wherein the first module is arranged such that each pixel of the first pixelated partial high beam (HB1) has a width or a height less than or equal to 0.5°.

13. The lighting device of claim 1, characterized in that the first pixelated electroluminescent light source or the second pixelated electroluminescent light source comprise at least one matrix array of a monolithic matrix array of electroluminescent elements.

* * * * *